United States Patent [19]

Fujiwhara et al.

[11] 4,192,681

[45] Mar. 11, 1980

[54] PROCESS FOR FORMING AN AMPLIFIED DYE IMAGE

[75] Inventors: Mitsuto Fujiwhara; Syunji Matsuo; Mikio Kawasaki; Toyoaki Masukawa; Yutaka Kaneko, all of Hino, Japan

[73] Assignee: Konishiroku Photo Industry Co., Ltd., Nihonbashi-Muro, Japan

[21] Appl. No.: 728,794

[22] Filed: Oct. 1, 1976

[30] Foreign Application Priority Data

Oct. 7, 1975 [JP] Japan ..... 50/121559

[51] Int. Cl.[2] ..... G03C 5/32; G03C 7/00

[52] U.S. Cl. ..... 430/373

[58] Field of Search ..... 96/56, 55, 74, 60 R

[56] References Cited

U.S. PATENT DOCUMENTS

| | | | |
|---|---|---|---|
| 3,411,904 | 11/1968 | Becker | 96/74 |
| 3,822,129 | 7/1974 | Dunn et al. | 96/74 |
| 3,841,873 | 10/1974 | Mowrey et al. | 96/60 R |
| 4,062,684 | 12/1977 | Hara et al. | 96/60 R |

*Primary Examiner*—Mary F. Kelley

*Attorney, Agent, or Firm*—Haseltine, Lake & Waters

[57] ABSTRACT

An improved process for forming an amplified dye image on an image-wise, exposed light-sensitive silver halide photographic material is described, which, after developing, is processed with an amplifying solution the improvement being in that (a) the coupler is in stoichiometric excess of at least 50% relative to the amount of silver halide, (b) the dry thickness ratio of the hydrophilic colloid layer to the silver halide emulsion layer is 1 to 10 and (c) the amplifying solution contains hydrogen peroxide.

6 Claims, No Drawings

PROCESS FOR FORMING AN AMPLIFIED DYE IMAGE

This invention relates to a process for forming amplified dye images and a light-sensitive silver halide color photographic material therefor. Particularly, the invention pertains to an improved process for the dye image-amplification of a light-sensitive silver halide color photographic material by treating the light-sensitive silver halide photographic material containing a coupler with an amplifying solution in the presence of the image-wire-distributed catalytic silver and a color developing agent, said light-sensitive silver halide photographic material having been reduced in content of the silver.

Because of its high sensitivity and excellent image forming property, a light-sensitive silver halide photographic material has been widely used in a variety of applications. In recent years, however, the world-wide shortage of mineral source of silver and a steep rise in silver price caused thereby throughout the world have become a matter of concern to the silver consuming industries. Particularly, in the field of manufacturing the light-sensitive silver halide photographic material in which large amounts of silver are used, great importance is attached to the matter as a primary factor that may also bring about a commercial disadvantage, and there is a strong and growing demand for technical achievement to cope with this difficulty. Under such circumstances, the art of preparing silver-saved type light-sensitive silver halide photographic materials has been pointed out as one of the techniques that are able to cope with this demand. Some techniques of the kind are already known and, as one of such techniques, there may be mentioned an image amplification method.

As conventional techniques concerning the image amplificaton method, there have been known as representatives thereof, for example, a method of amplifying images by means of peroxy compounds as disclosed in British Patent specification No. 1,268,126 and an amplification technique of color images utilizing the catalytic action of cobalt complexes or the like as disclosed in Japanese Laid-Open-to-Public No. 9728/1973. With respect to a similar amplification technique of color images, furthermore, on page 406 of "History of Color Photography" (1956), J. S. Friedman suggests the possibility of amplification of color images by means of hydrogen peroxide and p-phenylenediamine. All these methods have an effect in enhancing an image density in a very efficient manner and are useful means when considered from the standpoint of a saving of silver source.

In these amplification methods heretofore known, however, because of image silver being used as a catalyst, there are brought about various drawbacks associated therewith, for example, degradation of graininess or occurrence of strains due to diffusion of oxidation products resulting from the processing of multi-coated light-sensitive silver halide photographic material. Because of such undesirable characteristics, the photographic materials obtained by these known methods could not be put in practical use. For alleviating such defects as degradation of graininess, there has been made an attempt, for example, by reducing amounts of silver and a binder in comparison with that of a coupler, that is, a silver halide layer is made thin as much as possible, thereby allowing the coupler and silver halide to exist very closely and densely in the silver halide layer. In this method, however, it is not possible to prevent the occurrence of color stains in multi-coated light-sensitive silver halide photographic material, though the method was found fairly effective in improving graininess and enhancing efficiency of amplification.

We extensively studied and investigated into a process for amplifying dye images without the aforesaid color stains and then improving the aforesaid graininess, and eventually have turned their chief attention toward a hydrophilic colloid layer adjacent to a silver halide emulsion layer containing a coupler and found that the above object can be accomplished by thickening said hydrophilic colloid layer to a thickness exceeding a definite value in comparison with the silver halide emulsion layer.

That is, in the prior art light-sensitive silver halide photographic materials, there were observed only such bad influences that when a layer adjacent to a silver halide emulsion layer is increased in thickness, permeation into the lower layer of a developer is retarded, particularly in the case of multi-coated light-sensitive color photographic materials the lower layers are particularly desensitized, or gamma is lowered. We, however, have found that in the light-sensitive silver halide photographic materials used in the amplification technique of dye images, even when thickness of the aforesaid adjacent layer is made large, not only such bad influences as mentioned previously will not be seem but also such defects as may be seen in the amplification treatments heretofore known can be solved. According to the process of the present invention, moreover, there has been obtained such good result as may not be expected from the prior art that developing effect is accelerated with the increase in amount of a color developing agent which is brought into an amplification bath.

Accordingly, a primary object of the present invention to provide an improved amplification process for obtaining excellent dye images, which process is free from such drawbacks as have seen in the conventionally known techniques.

Another object of the present invention is to provide a novel light-sensitive silver halide photographic material which is particularly suitable for amplification treatment.

Other objects of the present invention will be apparent from the description that follows.

The light-sensitive silver halide photographic material according to the present invention has at least one silver halide emulsion layer containing a coupler being stoichiometrically in excess of at least 50% relative to the silver halide present in the silver halide emulsion layer and a hydrophilic colloid layer adjacent to said silver halide emulsion layer, a ratio in film thickness as dried of said hydrophilic colloid layer to said silver halide emulsion layer being 0.5, preferably 0.5 to 10, and most preferably 1 to 5. When relatively thick adjacent layers are provided in multi-coated light-sensitive silver halide photographic materials, not only the color strain as may be seen in the prior art methods can be effectively prevented but also additives incorporated into the adjacent layers do not diffuse during coating into other layers and allowed to exhibit their effects for the first time during development treatment. Thus, it has become possible to incorporate development inhibitors and color developing agents into the adjacent layers, which development inhibitors and color developing agents have heretofore been very difficult to incorporate into such adjacent layers, with the result that the graininess has come to be improved.

As the hydrophilic colloid used in layers adjacent to the aforesaid silver halide emulsion layer, gelatin is most preferable. If necessary, however, other hydrophilic colloids such as gelatin derivatives like phthalated gelatin, methacrylate gelatin, colloidal albumin, cellulose derivatives or synthetic binders such as polyvinyl compounds like polyvinyl alcohol can be used singly or preferably in combination with gelatin.

The hydrophilic colloid layer to be adjacent to a silver halide emulsion layer may be allowed to be present on either side of the silver halide emulsion layer. For example, the said hydrophilic colloid layer may be allowed to be present as an intermediate layer between multi-coated silver halide emulsion layers, or alternatively, said hydrophilic colloid layer may be allowed to be present between a silver halide emulsion layer and the surface of a support or between the silver halide emulsion layer and a subbing layer formed on the support, and in either case the objects of the present invention can be accomplished.

In the present invention, there is used a silver halide photographic emulsion which contains the silver halide and a photographic coupler being stoichiometrically present in excess of at least 50% relative to an effective amount of said silver halide. The silver halide used is any of silver chloride, silver bromide, silver iodide, silver chlorobromide, silver iodobromide and silver iodochlorobromide for example, and emulsions containing such silver halide may be prepared according to any known method. For instance, the silver halide emulsions according to the present invention may be the so-called conversion emulsions, Lippmann's emulsions, covered grain emulsions or those which have been previously been subjected to fogging in an optical or chemical manner, and these emulsions may be suitably selected according to the type and use of a desired light-sensitive photographic material. Further, the kind, content, mixing ratio and average particle size of silver halides and size distribution of silver halide particles may likewise be selected suitably according to the kind and use of a desired light-sensitive photographic material. For example, in the case of a light-sensitive photographic material where a relatively low speed and high image quality are required, an emulsion consisting mainly of a silver chloride emulsion with a fine grain size and relatively narrow size distribution is used. In the case that a high speed light-sensitive photographic material is required, on the other hand, an emulsion containing silver halides with relatively large grain size and with a relatively small content of silver chloride. In the case that direct positive type light-sensitive photographic material is required an emulsion which has been previously subjected to fogging is used. These silver halides used in the present invention can be chemically sensitized by means of active gelatin; sulfur sensitizers, e.g. allylthiocarbamide, thiourea and cystine; selenium sensitizers; reductive sensitizers, e.g. stannous salt and polyamine; noble metal sensitizers, e.g. gold sensitizers, concretely potassium aurithiocyanate, potassium chloroaulate and 2-aurosulfobenzothiazole methochloride or such sensitizers consisting of water-soluble salts of ruthenium, rhodium and iridium, concretely ammonium chloropalladate, potassium chloroplatinate and sodium chloropalladate (certain kinds of these compounds may act as sensitizers or fog inhibitors depending on their amount used) and these sensitizers may be used either singly or suitably in combination with other sensitizers such as a gold sensitizer in combination with a sulfur sensitizer or a gold sensitizer in combination with a selenium sensitizer, for example.

Further, the above-mentioned silver halides may be optically sensitized at a desired wavelength region using optical sensitizers such as cyanine dyes zeromethine dyes, monomethine dyes, dimethine dyes and trimethine dyes, or merocyanine dyes for example, and they may be used either singly or in combination (for example, super sensitization).

The silver halide is dispersed in a suitable hydrophilic colloid, thereby to constitute a light-sensitive layer. As the hydrophilic colloid used in the silver halide layers and other constitutive layers such as an intermediate layer, a protective layer or a filter layer, generally gelatin is most preferably used, but other hydrophilic colloids such as gelatin derivatives like phthalated gelatin and methacrylate gelatin, colloidal albumin, cellulose derivatives or synthetic resins like polyvinyl compounds (e.g. polyvinyl alcohol) can be used either singly or preferably in combination with gelatin.

The silver halide color photographic emulsion according to the present invention is incorporated with many kinds of couplers for forming a color image. Preferable couplers for the present invention include, for example, open-chain methylene type yellow couplers, 5-pyrazolone type magenta couplers and phenol type or naphthol type cyan couplers, and these couplers may be the so-called 2-equivalent type or 4-equivalent type couplers. It is also possible to use, in combination with the above-mentioned coupler, azo type colored couplers for automasking, oxazone type compounds or couplers so-called "development dye releasing" (DDR) couplers. It may be desirable to use the so-called colorless coupler, which is colorless prior to color development, in combination with the above-mentioned masking coupler. In order to improve photographic characteristics, the silver halide color photographic emulsion may contain, in combination with various couplers, couplers called the so-called competing couplers, DIR couplers (development inhibitor releasing couplers ) or BAR couplers. As the yellow couplers, open-chain ketomethylene compounds such as pivalylacetanilide type yellow couplers, those which are disclosed in French Patent specification No. 1,291,110 and, as benzoylacetanilide type yellow couplers, those which are disclosed in Japanese Patent Publication No. 19031/1971 and U.S. Pat. No. 2,875,051 can be preferably used. There may also be used the so-called 2-equivalent type couplers. Such couplers are those having an -O- allyl substitution at the active point of the coupler as disclosed in U.S. Pat. No. 3,408,194, those having an -O-acyl substitution at the active point of the coupler as disclosed in U.S. Pat. No. 3,447,928, those having a hydantoin compound substitution at the active point of the coupler as disclosed in Japanese Laid-Open-to-Public No. 29432/1973, those having a urazole compound substitution at the active point of the coupler as disclosed in Japanese Laid-Open-to-Public No. 66834/1973, those having a succinic acid imide compound substitution at the active point of the coupler as disclosed in Japanese Patent application No. 119053/1970, those having a monooxo imide compound substitution at the active point of the coupler as disclosed in Japanese Patent application No. 7930/1973, those having a pyridazone compound substitution at the active point of the coupler as disclosed in Japanese Patent application No. 10736/1974, those having a fluorine substitution at the active point of the coupler as disclosed in British Patent specification No. 94,490, those having a chlorine or bromine substitution at the active point of the coupler as disclosed in British Patent specification No. 780,507, and those having an -O- sulfonyl substituion at the active point of the coupler as disclosed in British Patent specification No. 1,092,506. Of the yellow couplers mentioned above, those which are particularly preferable may include such couplers as disclosed in U.S. Pat. No. 3,408,194, Japanese Laid-Open-to-Public No. 29432/1973, Japanese Patent application No. 79309/1973 and Japanese Laid-Open-to-Public No. 66834/1973.

As the magenta couplers usable in the present invention, there may be mentioned pyrazolone type, pyrazolonetriazole type, pyrazolinobenzimidazole type and indazolone type compounds. Usable as the pyrazolone type couplers, are those disclosed in U.S. Pat. Nos. 5,127,269, 2,600,788, 3,519,429, 3,419,391 and 3,062,653, British Patent specification No. 1,342,553, West German Patent Publication No. 2,162,778, Japanese Laid-Open-to-Public No. 29639/1974 and Japanese Patent application No. 8433/1969. The pyrazolonetriazole type magenta couplers include those disclosed in West German Patent Publication No. 1,810,464 and Belgian Patent specification No. 792,525. The pyrazolinobenzimidazole type magenta couplers may include those disclosed in U.S. Pat. No. 3,061,432, Japanese Patent Publication No. 60479/1971 and West German Patent Publication No. 2,156,111. Usable as the indazolone type magenta couplers, are those disclosed in Belgian Patent specification No. 769,166. As particularly preferable magenta couplers used in the present invention, there may be mentioned those as disclosed in Japanese Patent application No. 8433/1969 and 3-anilinopyrazolone magenta couplers as disclosed in U.S. Pat. No. 3,127,269.

As useful cyan couplers used in the present invention, there may be mentioned, for example, phenol compounds as disclosed in U.S. Pat. Nos. 2,423,730, 2,801,171 and 2,895,826, and Belgian Patent specification No. 779,512, naphthol compounds having an -O-aryl substitution at the active point as disclosed in U.S. Pat. No. 2,474,293 and British Patent specification No. 1,084,480, and phenol and naphthol compounds as disclosed in Japanese Laid-Open-to-Public No. 37425/1972, Japanese Patent applications Nos. 57829/1973, 69866/1973, 10787/1974, 25388/1974, 16057/1974 and 37160/1974.

As the colored magenta couplers, there may be used compounds having an arylazo substitution or hetearylazo substitution at the active point of colorless magenta coupler, and there may be mentioned, for example, compounds as disclosed in U.S. Pat. Nos. 3,005,712, 2,983,608 and 2,801,171, British Patent specification No. 937,621 and Japanese Patent application No. 8433/1969.

Usable as the colored cyan couplers, are compounds having an arylazo substitution at the active point as disclosed in U.S. Pat. Nos. 3,034,892 and 2,521,908, British Patent specification No. 1,255,111 and Japanese Patent application No. 55665/1971, and there may also be used such masking couplers of the type which react with the oxidation products of a developer, thereby to elude dyes into a treatment bath as disclosed in Japanese Patent applications Nos. 57829/1973, 69866/1973, 16057/1974, 25388/1974 and 37160/1974 and British Patent specification No. 1,084,480.

As the competing couplers, there may be used those as disclosed in U.S. Pat. No. 2,742,832, for example, citrazinic acid and the like, and usable as Weiss' couplers, are those as disclosed in West German Patent Publication No. 1,155,676.

The light-sensitive silver halide photographic material according to the present invention is prepared by forming on a support a silver halide emulsion layer containing a photographic coupler being present stoichiometrically in excess of at least 50% relative to an effective silver content in the emulsion layer, which has been prepared in the manner as explained hereinbefore, and a hydrophilic colloid layer of the present invention which is adjacent to said silver halide emulsion layer and, if necessary, in combination with other constitutive layers such as a subbing layer, an intermediate layer, a filter layer, an anti-curling layer and a protective layer, etc. As the support used in this case, there may be mentioned such substrates, either in a film-like or sheet-like form, as paper, laminated paper (e.g. a laminate of polyethylene and paper), glass, cellulose acetates, cellulose nitrates, polyesters, polycarbonates, polyamides, polystyrene and polyolefins. With the view of improving these supports in its adhesion to each of the constitutive layers to be formed thereon, the supports may be subjected to surface treatment including various treatments for imparting thereto hydrophilic property, for example, saponification treatment, corona discharge treatment, subbing treatment and setting treatment.

A light-sensitive photographic material of the present invention is composed of at least a support, a light-sensitive layer and an adjacent layer coated on the support. However, the light-sensitive photographic material of the present invention may have suitable layers at various positions on the support according to the object and is composed of several layers or more. Furthermore, the light-sensitive layer itself may be composed of a multi-coated layer comprising a layer containing a relatively high speed silver halide which has been color sensitized at the same or different wavelength region and a layer containing a relatively low speed silver halide.

In the light-sensitive photographic material of the present invention, the light-sensitive layer and/or other constitutive layers (e.g. intermediate layer, subbing layer, filter layer, protective layer, processing solution receiving layer and the like) may contain therein various photographic additives according to the object. Such photographic additives usable in the present invention may include, for example, stabilizers (mercury compounds, triazoles, azaindenes, quaternary benzothiazolium, zinc or cadmium salts); sensitizers such as quaternary ammonium salts and polyethylene glycols; film property improving agents, for example, glycerine, such dihydroxyalkanes as 1,5-pentanediol, esters of ethylenebisglycolic acid, bisethoxydiethyleneglycol succinate, amides of acrylic acid type acids and emulsified dispersed products of polymers; film hardeners, for example, formaldehyde, halogen-substituted aliphatic acids such as mucochloric acid and mucobromic acid, compounds having acid anhydride groups, dicarboxylic chloride, disulfonic chloride, biester of methanesulfonic acid, sodium bisulfite derivatives of dialdehyde in which aldehyde groups have been dispersed by means of 2 to 5 carbon atoms, bisazilidine, ethyleneimines; spreading agents, for example, saponin, lauryl or oleylmonoether of polyethylene glycol and salts of sulfated or alkylated polyethylene glycol; coating aids, for example, sulfosuccinates; organic solvents, for example, coupler solvents (high boiling organic solvents and/or low boiling organic solvents, concretely, dibutyl phthalate, tricresyl phosphate, acetone, methanol, ethanol, ethyl cellosolve and the like); the so-called DIR compounds which release a color development inhibitor at the time of color developing and simultaneously form a substantially colorless compound and, in addition, antistatic agents, defoaming agents, ultraviolet absorbers, fluorescent whitening agents, anti-sliding agents, matting agents and antihalation or anti-irradiation agents, and these additives are used either singly or in combination with others.

The light-sensitive silver halide photographic material used in the present invention is applicable to various uses. The light-sensitive silver halide photographic materials of the present invention may be used for the negative materials, the reversal materials, the direct positive materials and so forth.

The imagewise exposed light-sensitive silver halide photographic material of the present invention is, after development, brought into contact with an amplifying solution in the presence of imagewise-distributed silver and a color developing agent. Representatives of the developing agents preferably used in the present invention are those of p-aminophenol type and p-phenylenediamine type, which include, for example, p-aminophenoldiethyl-p-phenylenediamine hydrochloride, monomethyl-p-phenylenediamine hydrochloride, dimethyl-p-phenylenediamine hydrochloride, 2-amino-5-diethylaminotoluene hydrochloride, 2-amino-5-(N-ethyl-N-dodecylamino)-toluene, N-ethyl-N-β-methanesulfoneamidethyl-3-methyl-4-aminoaniline sulfate, N-ethyl-N-β-methanesulfonamidoethyl-4-aminoaniline, 4-N-ethyl-N-β-hydroxyethylaminoaniline, 4-amino-3-methyl-N,N-diethylaniline hydrochloride, 4-amino-3-methyl-N-ethyl-N-β-hydroxyethylaniline sulfate, 4-amino-3-β-(methanesulfonamide)ethyl-N,N-diethylaniline and 4-amino-N-(2-methoxyethyl)-m-toluidine.

The above-exemplified developing agents are used either singly or in combination of two or more agents and, if desired, they are used in combination with a black-and-white developing agent, for example, hydroquinone or the like. Further, the developer generally contains alkali agents, for example, sodium hydroxide, ammonium hydroxide, sodium carbonate, sodium sulfate and sodium sulfite, and further the developer may contain various additives, for example, halogenated alkali metals such as potassium bromide or development regulating agents, for example, citrazinic acid and the like. This color developer is being incorporated in advance into an image receiving material, for example, in a certain kind of diffusion transfer method, and in such technique it is also possible to adopt such a process in which the color developing agent is separated from the developer and, only an alkali agent is incorporated into the image receiving material or the color developing agent is incorporated therein and at the time of development the image receiving material is treated with the other solution. Furthermore, the above-exemplified developing agents may be incorporated, if desired, into a light-sensitive silver halide photographic material.

To the present invention are applicable various dye image amplification methods, for example, a method involving the treatment using hydrogen peroxide as disclosed in Japanese Patent Publication No. 46419/1974, Japanese Patent Applications Nos. 70907/1974, 80321/1974 and 109213/1974, or an amplification method involving the treatment by use of cobalt (III) complex as disclosed in Japanese Laid-Open-to-Public Nos. 9728/1973 and 9727/1973, U.S. Pat. No. 3,748,138 and Japanese Laid-Open-to-Public No. 23634/1974. The amplification method with the use of a hydrogen peroxide solution is more advantageously applicable to the present invention. Further, contact of a light-sensitive silver halide photographic material with am amplifying solution may be carried out according to an ordinary procedure for treating general light-sensitive silver halide photographic material. However, such treatment, for example, spray treatment or intermittent immersion treatment, may also be effectively applicable to the present invention. In addition to the above-mentioned treatments, the light-sensitive photographic material of the present invention is subjected, if necessary, to film hardening pretreatment, pre-bath treatment for more facilitation of soaking a color developing agent, black-and-white development treatment in the case of reversal development, and bleaching treatment. For removing silver halides or developed silver from the treatment system, there is used a fixing solution, a bleaching solution or a bleach fixing solution in combination with various treatments, for example, rinsing, stopping treatment and treatment with stabilizing solution. As the fixing component, there is used such silver halide solvents such as sodium thiosulfate, ammonium thiosulfate or the like, and as the bleaching component, there is used potassium ferricyanate, ferric ammonium ethylenediaminetetraacetate or the like.

In carrying out the treatment process according to the present invention, various methods may be applicable to transport of the light-sensitive silver halide photographic material to be treated therewith, and various types of treatment apparatuses employed therefor. Representatives of such apparatuses include, for example, those of the hanger type, cine type, roller transport type and Versamat-type.

The present invention is illustrated below more concretely with reference to examples, but embodiments of the invention are not limited thereto.

EXAMPLE 1

A solution of 2-(1-benzyl-2,4-dioxoimidazolidine-3-yl)-2-pivalyl-2'-chloro-5'-[4-(2,4-di-tert-pentylphenoxy)-butaneamide]acetanilide, as a coupler, in dibutyl phthalate was protect dispersed in an aqueous gelatin solution, and then an admixture of the dispersion with a silver bromide emulsion was coated on a resin-coated paper. The amounts of the coupler and silver thus used per 100 $cm^2$ of the resultant coating were 8.23 mg and 0.40 mg, respectively. On the surface of the coating thus formed on the paper was provided a gelatin intermediate layer. Subsequently, a solution of 3-{2-chloro-5-[1-octadecenyl)-succinimide]anilino}-1-(2,4,6-trichlorophenyl)-5-pyrazolone, as a coupler, in dibutyl phthalate was protect-dispersed in an aqueous gelatin solution, and then an admixture of the dispersion with a green-sensitive silver chlorobromide emulsion was coated on the surface of the thus formed gelatin intermediate layer and then dried. The amounts of the coupler and silver used in the ortho layer thus formed were respectively 4.3 mg and 0.45 mg per 100 $cm^2$ of the layer. A gelatin solution was coated on the layer thus formed, and then a solution of 2-[2-(2,4-di-tert-pentylphenoxy)-butaneamido]-4,6-dichloro-5-methyl-phenol, as a coupler, in dibutyl phthalate was protect-dispersed in an aqueous gelatin solution, and then an admixture of the dispersion with a red-sensitive silver chlorobromide emulsion was coated on the thus formed gelatin layer and then dried. On the thus formed layer were provided further a gelatin protective layer and a ultraviolet absorbing layer containing a ultraviolet absorbing agent in that order, thereby to obtain a light-sensitive color paper material. The amounts of the coupler and silver used in the panchromatic layer thus formed were 2.9 mg and 0.30 mg, respectively, per 100 $cm^2$ of the layer.

In the preparation of light-sensitive color paper materials according to the above-mentioned process of the present example, the constitutive silver halide emulsion layers and adjacent layers in each material were respectively changed in film thickness (as dried) in the manner as shown in Table 1.

Table 1

| Sample<br>Dry film thickness | A (Outside the invention | B (Outside the invention | C (Present invent-tion) | D (Outside the invention |
|---|---|---|---|---|
| Regular layer | 4.0 μ | 1.8 μ | 1.2 μ | 4.0 μ |
| First intermediate layer | 1.0 | 1.0 | 3.5 | 3.5 |
| Ortho layer | 3.0 | 1.4 | 1.4 | 3.0 |
| Second intermediate layer | 1.0 | 1.0 | 3.5 | 3.5 |
| Panchromatic layer | 2.5 | 1.2 | 1.8 | 2.5 |
| Protective layer | 1.0 | 1.0 | 1.0 | 1.0 |

Each of the samples thus prepared was exposed through an optical wedge to blue, green and red lights, respectively, and then subjected to development treatment according to the under-mentioned treatment steps. (Except for rinsing, every treatment step was carried out at 30° C.) A series of the treatment steps involved the developing (1.5 minutes)→amplifying (4 minutes)→rinsing (1 minute)→bleach fixing (1 minute)→rinsing (2 minutes)→stabilizing (20 seconds)→drying.

The processing solutions used in the above-mentioned development treatment had their respective compositions as shown below.

| | |
|---|---|
| Developer: | |
| Anhydrous sodium sulfite | 10 g |
| Hydroquinone | 2 g |
| Phenidone | 0.6 g |
| Potassium carbonate | 20 g |
| N-Ethyl-N-β-methanesulfonamidoethyl-4-amino-3-methylaniline sulfate | 11 g |
| Sodium hydroxide | 5 g |
| Benztiazole | 0.5 g |
| Pure water to make 1 liter and adjust to pH | 11.0. |
| Amplifying solution: | |
| 38% Hydrogen peroxide solution | 10 ml |
| Water to make | 1 liter |
| Bleach fixing solution: | |
| Ferric ammonium ethylenediamine-tetraacetate | 61.0 g |
| Ammonium thiosulfate | 124.5 g |
| Sodium metabisulfite | 13.3 g |
| Diammonium ethylenediaminetetraacetate | 5.0 g |
| Water to make 1 liter and ajust to pH 6.5. | |
| Stabilizing solution: | |
| Glacial acetic acid | 20 ml |
| After addition of 800 ml of water, adjust to pH 3.5–4.0, and then water to make 1 liter. | |

Each sample thus developed was tested for its blue, green, and red densities (hereinafter abbreviated to $D_B$, $D_G$, and $D_R$, respectively) under exposure to blue, green, and red lights using an automatic recording sensitometer (PD 7-R, manufactured by Konishiroku Photo Industry Co., Ltd.). The measurements of a value of $D_G$ when $D_B=1.0$ under the blue light exposure, those of $D_B$ and $D_R$ when $D_G=1.0$ under the green light exposure, and that of $D_G$ when $D_R=1.0$ under the red light exposure were conducted, whereby the results as shown in Table 2 were obtained.

Table 2

| Sample | A | B | C | D |
|---|---|---|---|---|
| $D_G$ under blue light exposure | 0.30 | 0.32 | 0.15 | 0.15 |
| $D_B$ under green light exposure | 0.40 | 0.42 | 0.23 | 0.23 |
| $D_R$ under green light exposure | 0.30 | 0.33 | 0.18 | 0.18 |
| $D_G$ under red light exposure | 0.33 | 0.34 | 0.20 | 0.19 |
| Graininess* | Coarse | Good | Good | Good |
| Specific speed of the lowermost layer** | 100 | 101 | 100 | 85 |

*Graininess: Each sample was visually inspected by magnifying it about 100 times.
**The specific speed of the lowermost layer was represented by a relative value measured by assuming as 100 the speed of the lowermost layer of the sample A.

In the case of the sample C, it is understood from the above results that when the regular, ortho and panchromatic layers independently developed color, the other layer adjacent thereto was relatively small in the extent of color development and hence the color stain which might be brought about could be reduced to that extent, and also that both graininess and developability of the lowermost layer were found favorable. In the case of the sample D, however, where all the layers were increased in film thickness, not only its graininess could not be improved but also the increased film thickness exerted an adverse effect on development of the lowermost layer, with the result that the development of the lowermost layer became somewhat insufficient and the speed became insufficient. In the case of the sample B, on the other hand, where all the layers were descreased in film thickness, the color stain was brought about, and there remain some problems from the standpoint of practical use.

EXAMPLE 2

A mixed solution of 1-hydroxy-N-[4-(2,4-di-tert-pentylphenoxy)butyl]-2-napthamide (10.1 mg), 4-(2-ethoxycarbonylphenylazo)-1-hydroxy-N-[4-(2,4-di-tert-pentylphenoxy)butyl]-2-naphthamide (3.2 mg) and 1-oxo-2-(1-phenyl-5-tetrazolylthio)-6-(2,4-di-tert-pentylphenoxyacetamido)-indane (4.3 mg) in tricresyl phosphate was protect-dispersed in an aqueous gelatin solution, and then an admixture of the dispersion with a high speed red-sensitive silver iodobromide emulsion was coated on a cellulose triacetate transparent film base (Ag: 3.5 mg). After coating a gelatin solution of di-tert-octylhydroquinone on the surface of the layer thus formed on the film base. A mixed solution of 1-(2,4,6-trichlorophenyl)-3-[3-(2,4-di-tert-pentylphenoxy-acetamido)benzamido]-5-pyrazolone (10.2 mg), 1-(2,4,6-trichlorophenyl)-3-[3-(2,4-di-tert-pentylphenoxy-acetamido)benzamido]-4-(4-methoxyphenylazo)-5-pyrazolone (2.2 mg) and 1-oxo-2-(1-phenyl-5-tetrazolylthio)-6-(2,4-di-tert-pentylphenoxy-acetamido)-indane (0.6 mg) in dibutylphthalate was protect-dispersed in an aqueous gelatin solution, and then an admixture of the dispersion with a high speed green-sensitive silver iodobromide emulsion was coated (Ag: 2.1 mg) on the gelatin layer thus formed. After providing a colloid silver yellow filter layer containing 2,5-di-tert-octylhydroquinone on the green-sensitive emulsion layer thus formed, a solution of 2-(1-benzyl-2,4-dioxoimidazolidine-3-yl)-2-pivalyl-2'-chloro-5'-[2-(3-pentadecylphenoxy)-butanamido]acetanilide (2.5 mg) in dibutyl phthalate was protect-dispersed in an aqueous gelatin solution, and then an admixture of the dispersion with a high speed blue-sensitive silver iodobromide emulsion (Ag: 3.0 mg) was coated on the yellow filter layer thus formed. On the surface of the blue-sensitive emulsion layer thus formed was provided a gelatin protective layer, thereby to obtain a high speed light-sensitive photographic negative material. (In the foregoing statement, however, a value of unit weight of a substance indicated in parentheses, each occurrence, represents the amount of the substance used per 100 $cm^2$ of the resulting coating. Further, the amount of 2,5-di-tert-octylhydroquinone used in each case was 0.17 mg per 100 $cm^2$). According to the process for preparing the above-mentioned light-sensitive photographic negative material, there were prepared samples A and B, which were different infilm thickness of intermediate layers and emulsion layers, as shown in Table 3.

Table 3

| Sample / Dry film thickness | A | B |
|---|---|---|
| Anti-halation layer | 2.5 | 1.5 |
| Panchromatic layer | 6.6 | 2.7 |
| First intermediate layer | 0.7 | 6.0 |
| Ortho layer | 5.1 | 2.5 |
| Second intermediate layer (Yellow filter layer) | 1.8 | 6.4 |
| Regular layer | 5.3 | 2.6 |
| Protective layer | 1.1 | 1.1 |

The samples A and B were individually exposed through an optical wedge to blue, green and red lights and then subjected to development treatment as mentioned below.

A series of the treatment steps involved the color developing (3' 15")→amplifying solution (3' 15")→bleaching (6' 30")→rinsing (3' 15")→fixing (6' 30")→rinsing (3' 15")→stabilizing (1' 30"). The processing solutions individually used in the development treatment had their respective compositions as shown below.

| | |
|---|---|
| Developer: | |
| Anhydrous potassium carbonate | 26.0 g |
| Anhydrous sodium bicarbonate | 3.5 g |
| Potassium sulfite (dihydrate) | 18.0 g |
| Potassium bromide | 1.3 g |
| Sodium chloride | 0.2 g |
| Sodium nitrilotriacetate (monohydrate) | 2.0 g |
| Potassium hydroxide | 0.4 g |
| Hydroxylamine sulfate | 2.0 g |
| 4-Amino-3-methyl-N-methyl-(β-hydroxyethyl)aniline sulfate | 5.0 g |
| 2-Phenyl-5-mercaptotetrazole | 20 mg |
| Pure water to make 1 liter (pH 10.5) | |
| Amplifying solution: | |
| 38% Hydrogen peroxide solution | 25 ml |
| Pure water to make 1 liter | |
| Bleaching solution: | |
| Ferric ammonium ethylenediamine-tetraacetate | 100 g |

-continued

| | |
|---|---|
| Diammonium ethylenediamine-tetraacetate | 10.0 g |
| Ammonium bromide | 15.0 g |
| Glacial acetic acid | 10.0 ml |
| Pure water to make 1 liter (pH 6.0) | |
| Fixing solution: | |
| Ammonium thiosulfate (70% aqueous solution) | 175.0 ml |
| Anhydrous sodium sulfite | 8.6 g |
| Sodium metasulfite | 2.3 g |
| Pure water to make 1 liter (pH 6.0) | |
| Stabilizing solution: | |
| Formalin (37% aqueous solution) | 1.5 ml |
| Konidax (produced by Konishiroku Photo Ind. Co., Ltd.) | 2.5 ml |
| Water to make 1 liter | |

Except for the rinsing step, every treatment step was conducted at 38° C.

The samples A and B thus developed were individually tested in the same manner as in Example 1 to carry out measurements of a value of $D_G$ when $D_B=1.0$ in the case of the development treatment after exposure to blue light, values of $D_B$ and $D_R$ when $D_G=1.0$ in the case of the development treatment after exposure to green light, and a value of $D_G$ when $D_R=1.0$ in the case of the development treatment after exposure to red light, whereupon the results as shown in Table 4 were obtained. For comparison of graininess, the samples A and B were individually tested for their R.M.S. Granularity (Root Mean Square Granularity) at a density of 0.3 as well as of 0.9, to obtain the results as shown in Table 5. It is understood from these results that the sample falling within the scope of the present invention is markedly excellent in graininess and also less in color clouding.

Table 4

| | | |
|---|---|---|
| $D_G$ under blue light exposure | 0.28 | 0.16 |
| $D_B$ under green light exposure | 0.37 | 0.20 |
| $D_R$ under green light exposure | 0.28 | 0.18 |
| $D_G$ under red light exposure | 0.31 | 0.22 |

Table 5

| Sample | A | | B | |
|---|---|---|---|---|
| Density | 0.3 | 0.9 | 0.3 | 0.9 |
| RMS Granularity | | | | |
| $D_B$ | $45 \times 10^{-3}$ | $38 \times 10^{-3}$ | $40 \times 10^{-3}$ | $32 \times 10^{-3}$ |
| $D_G$ | $31 \times 10^{-3}$ | $23 \times 10^{<3}$ | $26 \times 10^{-3}$ | $19 \times 10^{-3}$ |
| $D_R$ | $25 \times 10^{-3}$ | $19 \times 10^{-3}$ | $20 \times 10^{-3}$ | $15 \times 10^{-3}$ |

EXAMPLE 3

The samples used in Example 1 were individually treated with a color developer having the following composition, followed by the same subsequent treatments as in Example 1.

| | |
|---|---|
| Color developer: | |
| Benzyl alcohol | 5.0 ml |
| Sodium hexametaphosphate | 2.5 g |
| Anhydrous sodium sulfite | 1.85 g |
| Potassium bromide | 0.50 g |
| Sodium bromide | 1.40 g |
| Borax | 39.1 g |
| Hexamminecobalt chloride | 10 g |
| N-Ethyl-N-β-methanesulfonamide-ethyl-4-amino-3-methylaniline sulfate | 5.0 g |

-continued

| Color developer: |
|---|
| Water to make 1 liter and adjust to pH 10.3 |

The samples thus developed were individually tested in the same manner as in Example 1 to carry out measurements of a value of $D_G$ when $D_B=1.0$ in the case of the development after exposure to blue light, values of $D_B$ and $D_R$ when $D_G=1.0$ in the case of the development after exposure to green light, and a value of $D_G$ when $D_R=1.0$ in the case of the development after exposure to red light, whereupon the results obtained were as shown in Table 6. For comparison of graininess, the samples were individually tested for their R.M.S. Granularity at a density of 0.3 as well as of 0.9, to obtain the results as shown in Table 7. It is understood from these results that the sample falling within the scope of the present invention is markedly excellent in graininess and also less in color clouding.

Table 6

| Sample | A | B |
|---|---|---|
| $D_G$ under blue light exposure | 0.28 | 0.16 |
| $D_B$ under green light exposure | 0.37 | 0.20 |
| $D_R$ under green light exposure | 0.28 | 0.18 |
| $D_G$ under red light exposure | 0.31 | 0.22 |

Table 7

| Sample | A | | B | |
|---|---|---|---|---|
| Density | 0.3 | 0.9 | 0.3 | 0.9 |
| RMS Granularity | | | | |
| $D_B$ | $45 \times 10^{-3}$ | $38 \times 10^{-3}$ | $40 \times 10^{-3}$ | $32 \times 10^{-3}$ |
| $D_G$ | $31 \times 10^{-3}$ | $23 \times 10^{-3}$ | $26 \times 10^{-3}$ | $19 \times 10^{-3}$ |
| $D^R$ | $25 \times 10^{-3}$ | $19 \times 10^{-3}$ | $20 \times 10^{-3}$ | $15 \times 10^{-3}$ |

EXAMPLE 4

A solution of 1-(2,4,6-trichlorophenyl)-3-[3-(2,4-di-tert-pentylphenoxy-acetamido)benzamido]-5-pyrazolone in dibutyl phthalate in the proportion of 1:1 was protect-dispersed in an aqueous gelatin solution, and then an admixture of the dispersion with a silver iodobromide emulsion (containing 4% silver iodide) was coated on a polyester base which had been subjected to corona discharge treatment followed by subbing treatment. The amounts of the coupler and silver used in that case were 7.0 mg and 1.84 mg, respectively, per 100 $cm^2$ of the resulting layer. After coating a gelatin layer on the emulsion layer thus formed, a solution of 1-hydroxy-N-[4-(2,4-di-tert-pentylphenoxy)butyl]-2-naphthamide in dibutyl phthalate was protect-dispersed in an aqueous gelatin solution, and then an admixture of the dispersion with a high speed silver iodobromide emulsion (containing 1.5% silver iodide) was coated on the gelatin layer. The amounts of the coupler and silver used in that case were 9.7 mg and 2.7 mg, respectively, per 100 $cm^2$ of the resulting layer. On the emulsion layer thus formed was provided a gelatin protective layer, thereby to obtain a sample. In that case, however, four kinds of samples were prepared by changing the emulsion layers and intermediate layer in their film thickness in the manner as shown in Table 8.

Table 8

| Sample<br>Dry film thickness | A | B | C | D |
|---|---|---|---|---|
| First emulsion layer | 9.0 | 5.0 | 9.0 | 5.0 |
| Intermediate layer | 1.0 | 9.0 | 9.0 | 1.0 |
| Second emulsion layer | 9.0 | 5.0 | 9.0 | 5.0 |
| Protective layer | 1.0 | 1.0 | 1.0 | 1.0 |

Each of the samples of light-sensitive color photographic materials for X-ray was subjected to X-ray irradiation through a fluorescent sensitizing paper and an aluminum wedge for 0.5 seconds at a tube voltage of 60 $KV_p$ and a current of 200 mA. Subsequently, each sample thus irradiated was developed at 30° C. for 1.5' with a developer having the following composition.

| Composition of developer: | |
|---|---|
| Anhydrous sodium sulfite | 10 g |
| Potassium carbonate | 20 g |
| Sodium hydroxide | 5 g |
| Hydroquinone | 25 g |
| Phenidone | 1.2 g |
| CD-3 (produced by Eastman Kodak Co.) | 10 g |
| Benzotriazole | 1.0 g |
| Pure water to make 1 liter (adjust to pH 11) | |

The sample thus developed was immediately immersed, without rinsing, into an amplifying bath having the following composition.

Hydrogen peroxide (35% aqueous solution) 10 ml
Water to make 1 liter

The thus treated sample was then subjected, after thorough rinsing, to a bleaching bath, fixing bath and then stabilizing bath, which are commonly used for general light-sensitive color photographic material, whereby a color X-ray image was obtained on the sample.

The samples thus treated were individually examined in their characteristics such as developability, color clouding and graininess, to obtain the results as summarized in Table 9.

Table 9

| Sample | A | B | C | C |
|---|---|---|---|---|
| Magenta color development at low exposed portion | Developed | — | — | Developed |
| Graininess | Coarse | Good | Coarse | Good |
| $D_G$ at hight exposed portion | 2.8 | 3.0 | 2.3 | 3.0 |

In both the samples A and D, there is observed the magenta color developed, which is ascribable to the fact that the high speed upper layer exerted its influence upon the lower layer, and this shows an occurrence of the so-called color clouding. Furthermore, the sample C is low in the green light density as measured at the high exposed portion, and this is considered ascribable to the fact that all the layers are exceedingly thick and consequently development of the lower layer becomes insufficient.

Thus, it is understood that the efficiency aimed at can be attained only when the emulsion layers are made thin and the intermediate layers thick.

What we claim is:

1. An improved process for forming an amplified dye image by:

(a) imagewise exposing a light-sensitive silver halide photographic material comprising a support and thereon at least one silver halide emulsion layer containing a silver halide and a coupler and further provided with a hydrophilic colloid intermediate layer adjacent to the silver halide emulsion layer, (b) developing the exposed material with a developer containing a color developing agent, and (c) processing the developed material with an amplifying solution in the presence of an imagewise-distributed metallic silver in the silver halide emulsion layer which acts as a catalyst and developing agent, the improvement of which comprises:

(1) the coupler being present stoichiometrically in excess of at least 50% relative to the amount of the silver halide, (2) the ratio in dry thickness of each hydrophilic colloid intermediate layer to the silver halide emulsion layer adjacent thereto in the photographic material being 1 to 10, and (3) the amplifying solution containing hydrogen peroxide.

2. The process according to claim 1, wherein said hydrophilic colloid layer comprises gelatin.

3. The process according to claim 2, wherein said silver halide emulsion layer comprises gelatin.

4. The process according to claim 1, wherein said amplifying solution contains hydrogen peroxide.

5. The process according to claim 1, wherein said color developing agent is a p-aminophenol compound or a p-phenylenediamine compound.

6. The process according to claim 3, wherein said hydrophilic colloid layer is adjacent to either side of said silver halide emulsion layer.

* * * * *